US009545547B1

(12) United States Patent
Abbott et al.

(10) Patent No.: US 9,545,547 B1
(45) Date of Patent: Jan. 17, 2017

(54) PUTTER WITH HINGED FACE COMPONENT

(71) Applicant: CALLAWAY GOLF COMPANY, Carlsbad, CA (US)

(72) Inventors: Craig E. Abbott, Vista, CA (US); Augustin W. Rollinson, Carlsbad, CA (US); Brett Carter, Carlsbad, CA (US); Kevin P. Dacey, La Jolla, CA (US); Daniel B. McFarland, Dana Point, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

(21) Appl. No.: 14/921,853

(22) Filed: Oct. 23, 2015

Related U.S. Application Data

(60) Provisional application No. 62/202,059, filed on Aug. 6, 2015.

(51) Int. Cl.
*A63B 53/04* (2015.01)

(52) U.S. Cl.
CPC .... *A63B 53/0487* (2013.01); *A63B 2053/0416* (2013.01)

(58) Field of Classification Search
CPC ..... A63B 53/0487
See application file for complete search history.

(56) References Cited

U.S. PATENT DOCUMENTS

| | | | | |
|---|---|---|---|---|
| 2004/0142762 | A1* | 7/2004 | Bunker | A63B 69/3685 473/340 |
| 2007/0021233 | A1* | 1/2007 | Blankenship | A63B 53/0487 473/329 |
| 2012/0088599 | A1* | 4/2012 | Narita | A63B 53/0487 473/329 |
| 2014/0038737 | A1* | 2/2014 | Roach | A63B 53/047 473/226 |

* cited by examiner

*Primary Examiner* — Michael Dennis
(74) *Attorney, Agent, or Firm* — Rebecca Hanovice; Michael Catania; Sonia Lari

(57) ABSTRACT

A golf club head comprising a hinged face component is disclosed herein. The face component is preferably a partial face cup with striking face, a flange, and a grooved hinge region between the striking face and the flange, which allows the striking face to flex and improves the sound of the striking face when it makes contact with a golf ball. The face component can be L-shaped, r-shaped, or cup shaped, and the groove preferably extends along the entire horizontal length of at least one hinge. In other embodiments, the groove may extend along a horizontal midline of the rear surface of the face cup striking face.

15 Claims, 8 Drawing Sheets

PUTTER WITH HINGED FACE COMPONENT

CROSS REFERENCES TO RELATED APPLICATIONS

The present application claims priority to U.S. Provisional Patent Application No. 62/202,059, filed on Aug. 6, 2015, the disclosure of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head, particularly a putter, with a face component comprising a hinged portion.

Description of the Related Art

The prior art discloses many different types putter faces, including inserts made of different types of polymers and/or metal materials. There is, however, still a need for a putter face that provides greater spin control.

BRIEF SUMMARY OF THE INVENTION

One aspect of the present invention is a putter comprising an L-shaped or r-shaped face insert with a groove disposed at its hinge region. Another aspect of the present invention is a putter comprising a floating face insert that contacts the rest of the head only at a few select points. Yet another aspect of the present invention is a putter comprising a face insert with a groove extending along a horizontal midpoint of a striking face portion.

Yet another aspect of the present invention is a putter-type golf club head comprising a body comprising a heel end, a toe end, an aft end, a face, a crown, a sole, and a recess, and an L-shaped face insert comprising face portion, a sole portion, and a hinge portion, wherein the recess comprises a face region and a sole region, wherein the face portion is disposed in the face region and the sole portion is disposed in the sole region, wherein the sole portion is affixed to the body within the sole region, and wherein the face portion is not affixed to the body. In some embodiments, the hinge portion may comprise a groove, which may extend along an entire horizontal length of the hinge portion, and which may be disposed in an inner surface of the hinge portion. In other embodiments, each of the body and the face insert may be composed of one or more metal materials, and the sole portion may be welded to the body within the sole region. In another embodiment, the body may further comprise a sound chamber, which may include a primary chamber and a secondary chamber, the primary chamber may communicate with the recess, and the body, the sound chamber, and the face insert may amplify the sound generated by the putter-type golf club head striking a golf ball. In any of these embodiments, the face portion of the face insert may have a variable thickness pattern.

Another aspect of the present invention is a putter-type golf club head comprising a body comprising a heel end, a toe end, an aft end, a face, a top portion, a sole portion, and a recess, and a partial face cup comprising a face portion, a crown portion, a sole portion, and a hinge portion disposed between the face portion and the crown portion, wherein the recess comprises a face region and a sole region, wherein the crown portion is affixed to the body within the face region at a location proximate the top portion, and wherein the face portion and the sole portion are not affixed to the body. In some embodiments, the hinge portion may comprise a groove, which may extend along an entire horizontal length of the hinge portion, either in an inner surface of the hinge portion and/or an external surface of the hinge portion. In some embodiments, each of the body and the face insert may be composed of one or more metal materials, and the face insert may be welded to the body. In others, the face portion of the face insert may have a variable thickness pattern. In a further embodiment, the body may comprise a sound chamber, which may have a primary chamber and a secondary chamber, the primary chamber may communicate with the recess, and the body, the sound chamber, and the face insert may amplify the sound generated by the putter-type golf club head striking a golf ball.

Yet another aspect of the present invention is a putter-type golf club head comprising a body comprising a heel end, a toe end, an aft end, a face portion, a rear surface opposite the face portion, a crown portion, and a sole portion, a face insert, and at least two pins, wherein the face portion comprises a recess having the same approximate size and shape as the face insert, wherein the at least two pins are disposed within the recess and connect the face insert to the body, wherein the at least two pins space the face insert from the body, and wherein the face insert does not make contact with any portion of the body. In some embodiments, the recess may comprise an upper toe-side corner, an upper heel-side corner, a lower toe-side corner, and a lower heel-side corner, the at least two pins may comprise a first pin and a second pin, the first pin may be at least partially disposed in the upper toe-side corner, and the second pin may be at least partially disposed in the upper heel-side corner. In other embodiments, each of the body, the face insert, and the at least two pins may be composed of one or more metal materials, the at least two pins may be welded to the body, and the face insert may be welded to the at least two pins. In still other embodiments, the face insert may be spaced a distance of at least 0.005 inch and no more than 0.100 inch from the face portion along a horizontal axis extending from the face portion through the aft end of the body. In any of these embodiments, the face insert may be capable of pivoting around the at least two pins.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
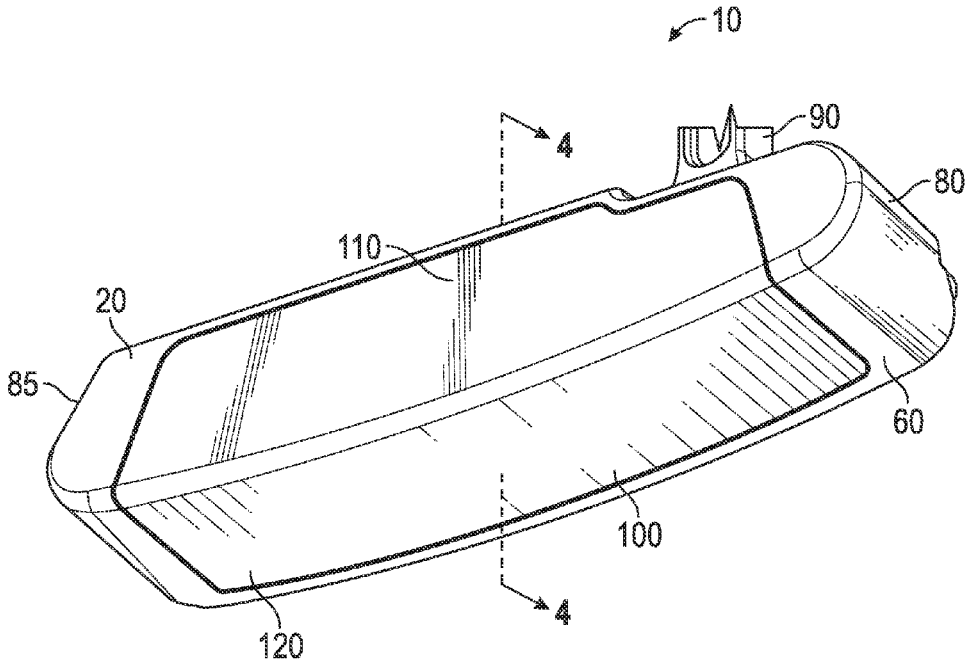
FIG. 1 is a bottom perspective view of a first embodiment of the present invention.
Figure 2:
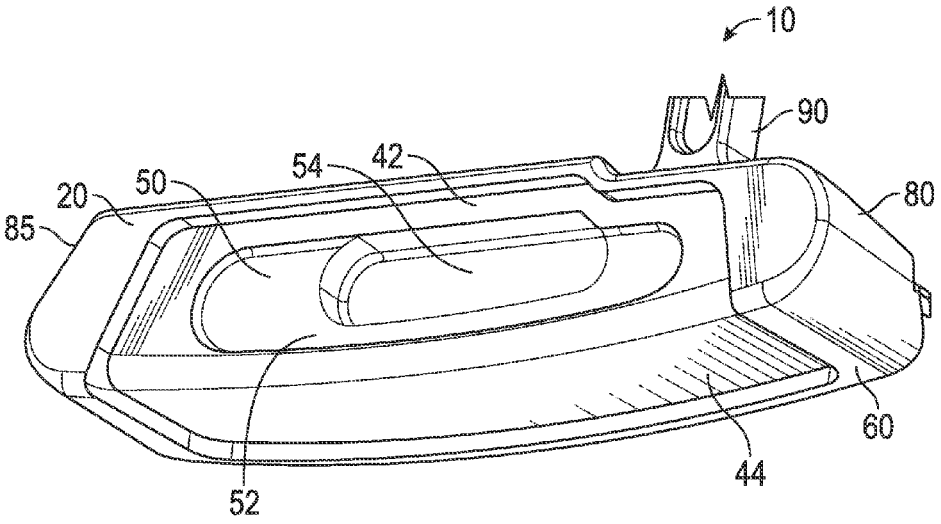
FIG. 2 is a bottom perspective view of the embodiment shown in FIG. 1 without a face insert.
Figure 3:
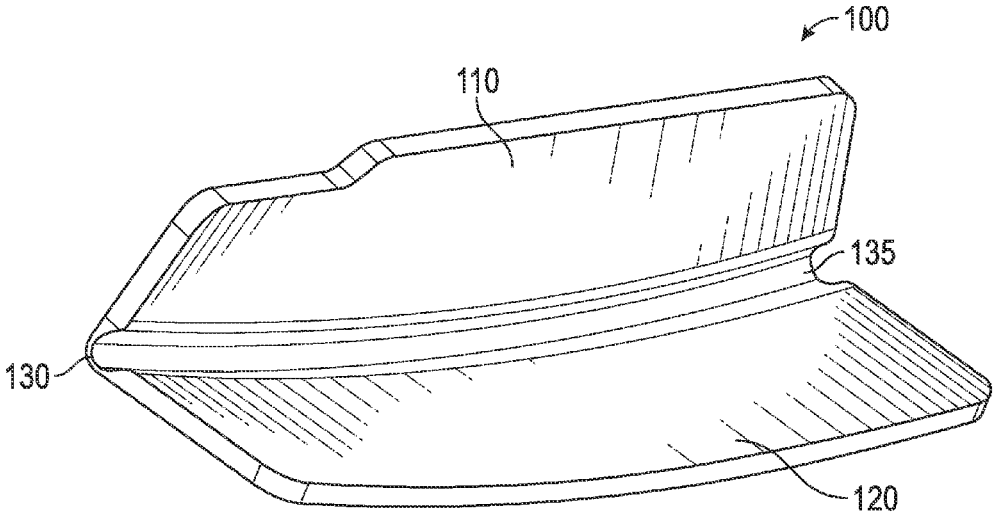
FIG. 3 is a rear perspective view of the face insert engaged with the putter shown in FIG. 1.
Figure 4:
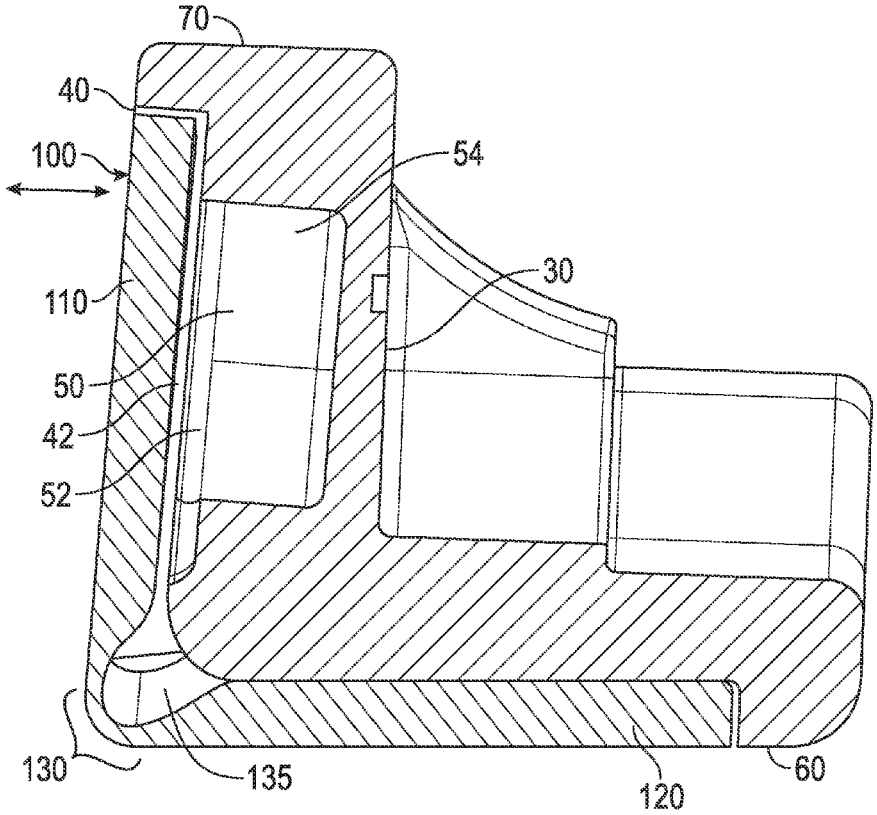
FIG. 4 is a cross-sectional view of the embodiment shown in FIG. 1 along lines 4-4.
Figure 5:
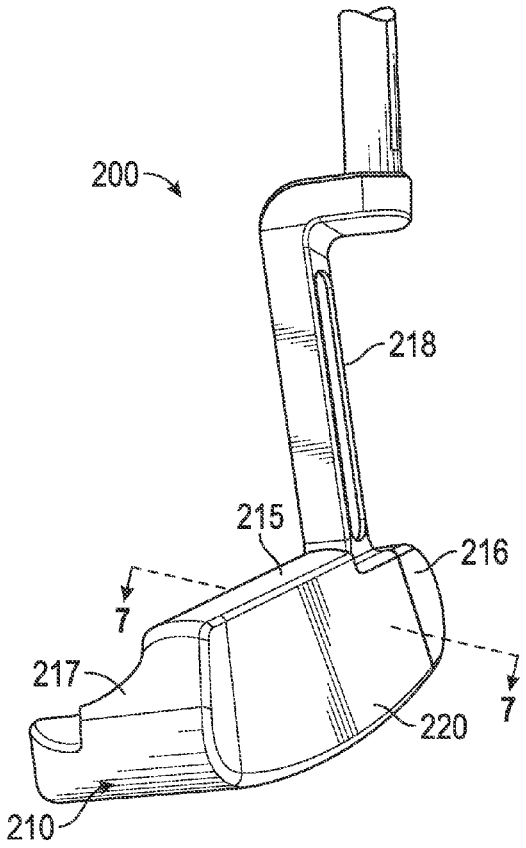
FIG. 5 is a side perspective view of a second embodiment of the present invention.
Figure 6:
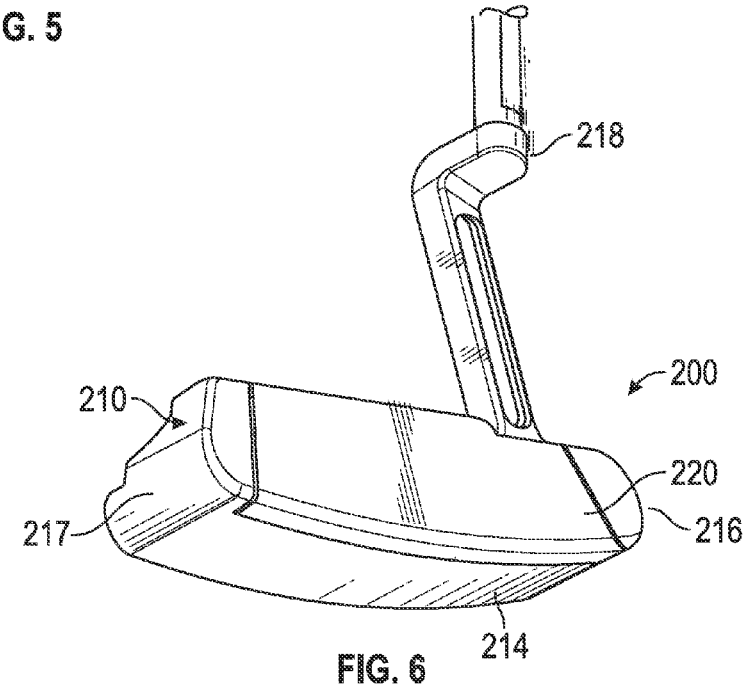
FIG. 6 is a front elevational view of the embodiment shown in FIG. 5.

The present invention is directed to a golf club head, and particularly a putter, having a face insert designed to give a golfer control over the spin imparted to a golf ball when the insert impacts said ball.

In a first, preferred embodiment, shown in FIGS. 1-4, the putter head 10 has a face 20, a rear surface 30 opposite to, and approximately parallel with, the face 20, a recessed area 40 with a face region 42 and a sole region 44, a sound chamber 50 with a primary chamber 52 and a secondary chamber 54, a sole portion 60, a top portion 70, a heel 80, a toe 85, a hosel 90, and an L-shaped face insert 100, also called a partial face cup, having a face portion 110, a sole portion 120, and a hinge portion 130 where the face and sole portions 110, 120 meet. The sound chamber 50 may have any of the features or dimensions disclosed in U.S. patent application Ser. No. 14/662,400, the disclosure of which is hereby incorporated by reference in its entirety herein. The face insert 100 preferably is composed of a metal material, but in other embodiments may be a polymeric material such as plastic or urethane.

The hinge portion 130 includes a groove 135, which preferably extends the entire horizontal length of the hinge portion 130 but in other embodiments may only extend along part of the length of the hinge portion 130. The groove 135 preferably is disposed on the inner surface of the hinge portion 130, such that it is hidden from view when the face insert 100 is affixed to the head 10, but in other embodiments the groove 135 may be on an external surface of the hinge portion 130 and thus be visible to a golfer. The groove 135 allows the face portion 110 of the face insert 100 to flex inwards towards the sound chamber 50 when it impacts a ball, and imparts a different amount of topspin to the ball depending on where the ball strikes the face portion 110. The face insert 100 is affixed to the putter head 10 only at the sole region 44 of the recessed area 40; the face portion 110 of the face insert 100 preferably is not attached to any portion of the putter head 10 so that it can flex into and out of the face region 42 of the recessed area 40 independently of the putter head 10. The sole portion 120 of the face insert 100 preferably is welded within the sole region 44 of the recessed area 40, but in other embodiments may be permanently or removably attached with an adhesive material.

In an alternative embodiment, the putter head 10 may have all of the same elements as the first embodiment, except that the recessed area 40 comprises a face region 42 and a crown region 46, and the face insert 100 is r-shaped, such that it has a face portion 110, a crown portion 140, and a hinge portion 130 with a groove 135 extending along an inner surface of the hinge portion 130. In this embodiment, the crown portion 140 is affixed within the crown region 46 of the recessed area and the face portion 110 is unattached to any portion of the putter head 10.

Figure 7:
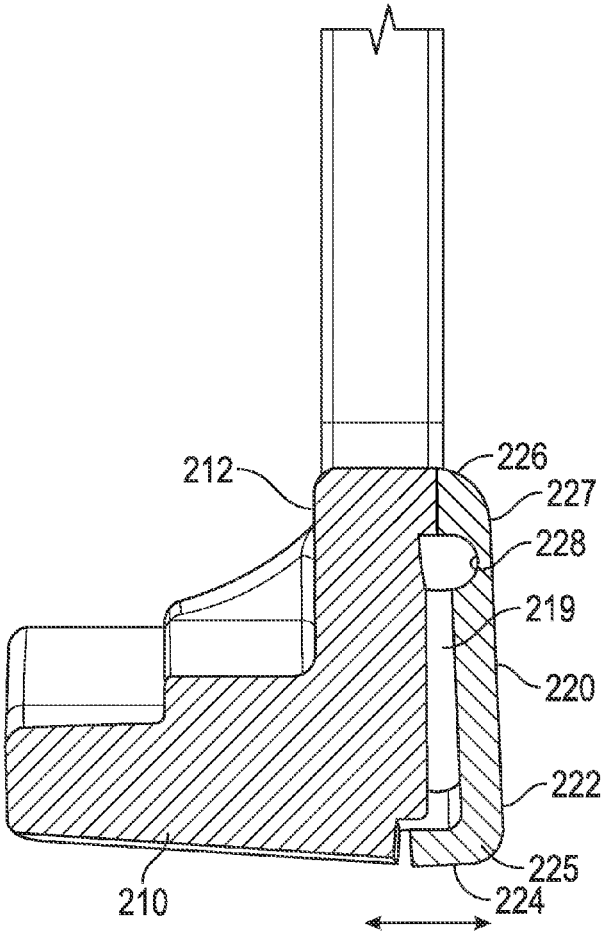
FIG. 7 is a cross-sectional view of the embodiment shown in FIG. 5 along lines 7-7.
Figure 8:
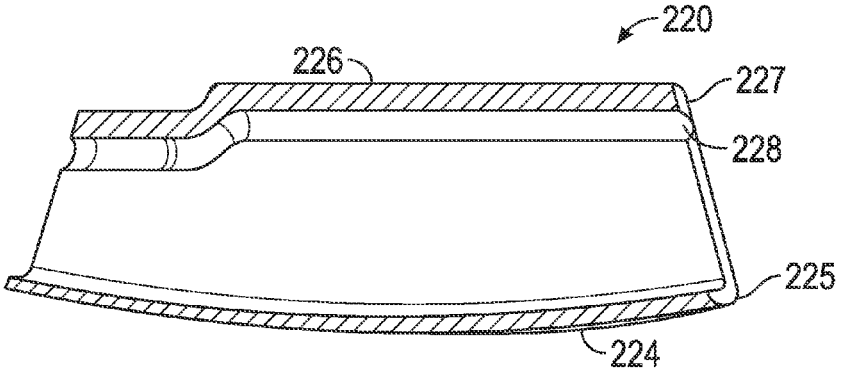
FIG. 8 is a rear plan view of the face insert of the embodiment shown in FIG. 5.
Figure 9:
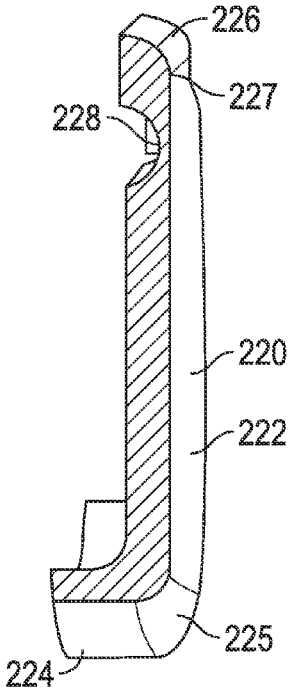
FIG. 9 is a side elevational view of the face insert shown in FIG. 8.
Figure 10:
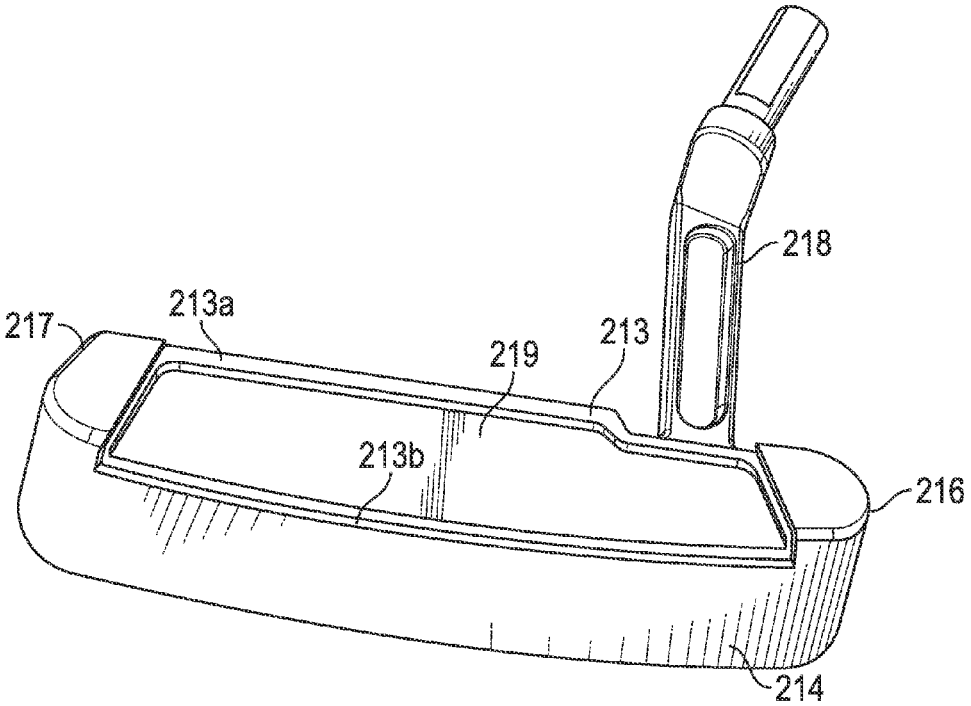
FIG. 10 is a bottom perspective view of the embodiment shown in FIG. 5 without the face insert.

A second embodiment is shown in FIGS. 5-10. In this embodiment, the putter head 200 has a body 210 with a face 211, a rear surface 212, a recessed area 213 with a face portion 213*a* and a sole portion 213*b*, a sole portion 214, a top portion 215, a heel 216, a toe 217, a hosel 218, and a sound chamber 219, and a face insert 220 sized to fit within the recessed area 213. The face insert 220 is a partial face cup, with a face portion 222, a sole portion 224, a sole hinge 225 between the face and sole portions 222, 224, a crown portion 226, a crown hinge 227 between the face and crown portions 222, 226, and a groove 228 disposed on the interior surface of the crown hinge 227. The groove 228 preferably extends along the entire length of the crown hinge 227 as shown in FIG. 8, but in other embodiments may only extend along part of the length of the crown hinge 227. The groove 228 preferably is disposed on the inner surface of the crown hinge 227, such that it is hidden from view when the face insert 220 is affixed to the head 220, but in other embodiments the groove 228 may be on an external surface of the crown hinge 227 and thus be visible to a golfer.

The groove 228 allows the face and sole portions 222, 224 of the face insert 220 to flex inwards towards the sound chamber 219 when the face portion 222 impacts a ball, and imparts a different amount of topspin to the ball depending on where the ball strikes the face portion 222. As shown in FIG. 7, the crown portion 226 of the face insert 220 is affixed to the body 210 in the face portion 213*a* of the recessed area 213 only proximate the top portion 215 of the body 210. The face portion 222 of the face insert 220 preferably is not attached to any portion of the body 210 so that it can flex into and out of the face portion 213*a* of the recessed area 213 independently of the body 210. The sole portion 224 of the face insert 220 also is not affixed to any portion of the body 210, as shown in FIG. 7, so that the face insert 220 can flex inwards when it makes contact with a golf ball.

Figure 11:
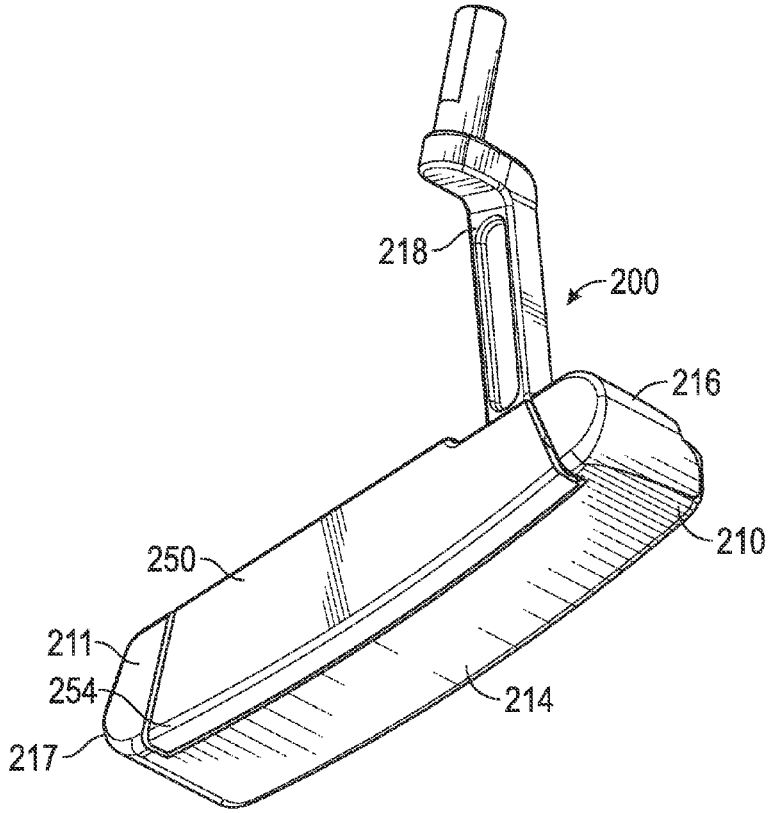
FIG. 11 is a bottom perspective view of a third embodiment of the present invention.
Figure 12:
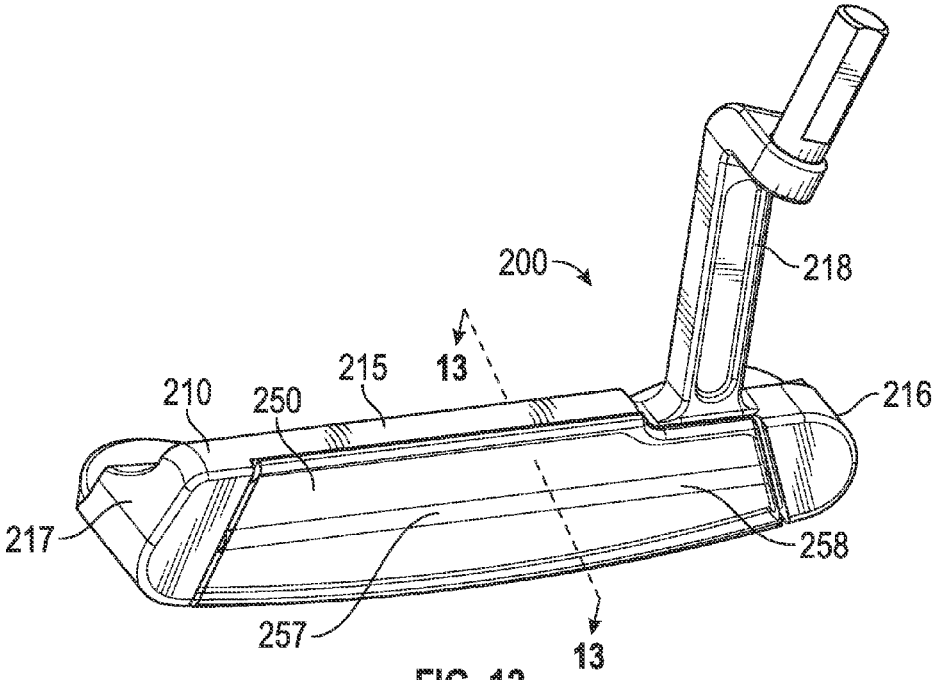
FIG. 12 is a front, elevational, partially transparent view of the embodiment shown in FIG. 11.
Figure 13:
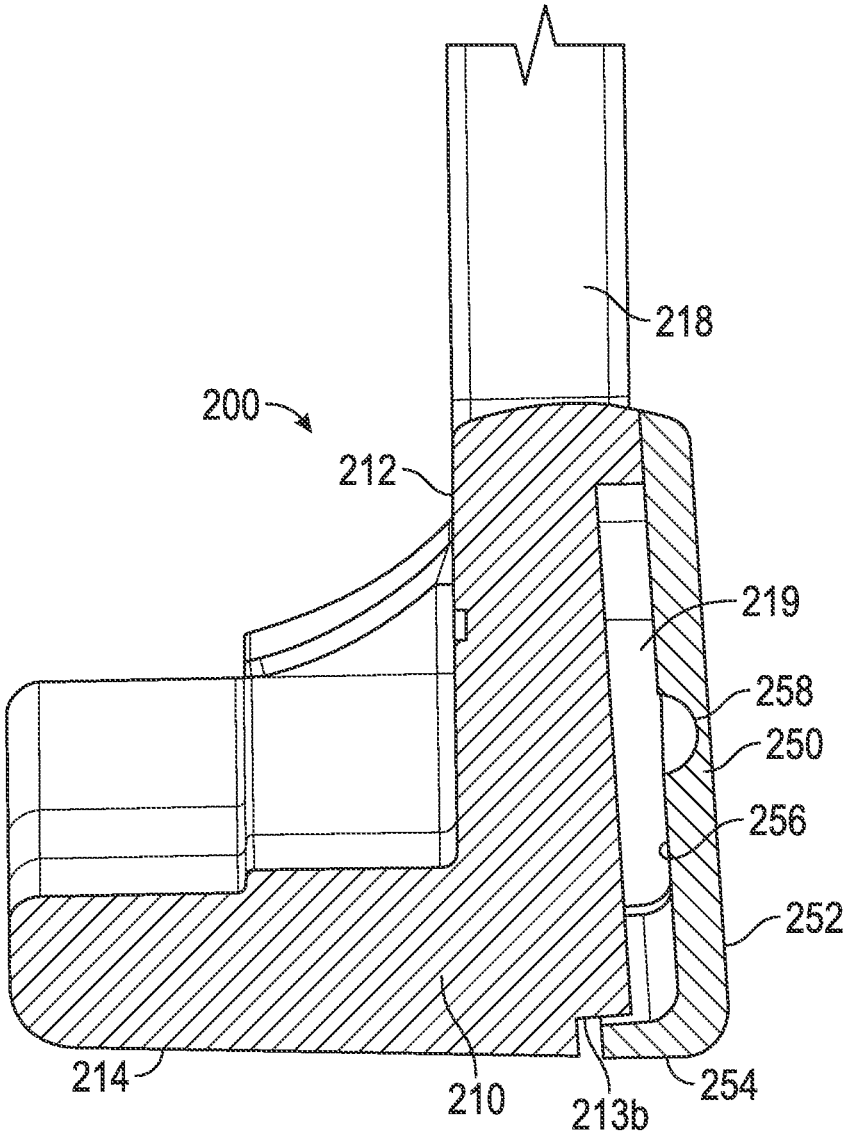
FIG. 13 is a cross-sectional view of the embodiment shown in FIG. 12 along lines 13-13.

The putter head 200 of the third embodiment, shown in FIGS. 11-13, is identical to that of the second embodiment, except that the groove 258 in the face insert 250 is disposed along a horizontal midline 257 on the rear surface 256 of the face portion 252. This groove 258 allows the lower region of the face portion 252 and the sole portion 254 of the face insert 250 to flex inwards towards the sound chamber 219 when the face portion 252 impacts a ball.

Figure 14:
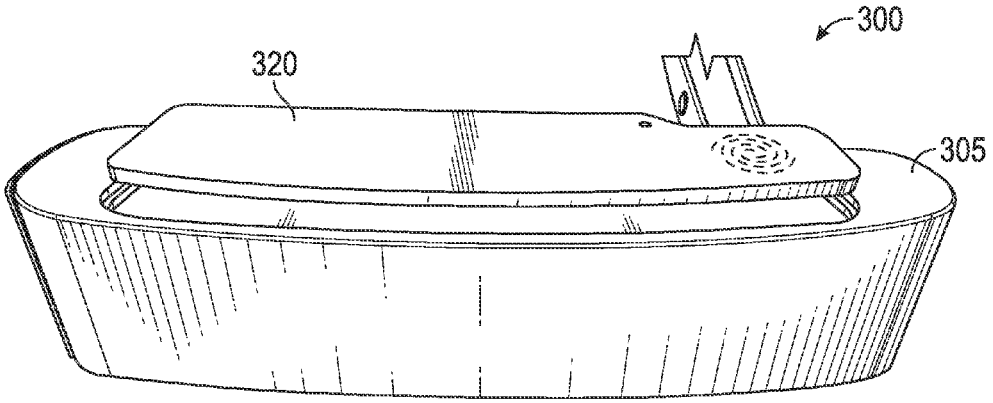
FIG. 14 is a bottom elevation view of a fourth embodiment of the present invention.
Figure 15:
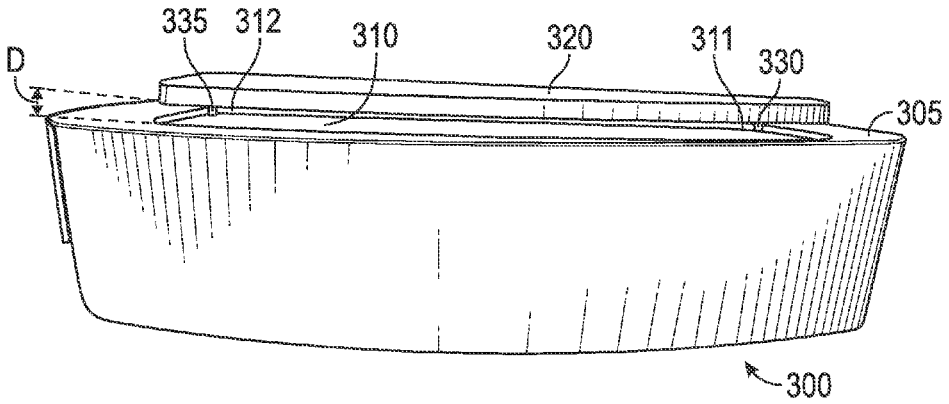
FIG. 15 is another bottom elevation view of the embodiment shown in FIG. 14.

In a fourth embodiment, shown in FIGS. 14 and 15, the putter head 300 has all of the same elements as the preferred embodiment, except that the recessed area 310 is only located in the face 305, and the face insert 320 does not have any rearward extending portions. In this embodiment, a pair of pins 330, 335 extend from the two upper corners 311, 312 of the recessed area 310 and elevate the face insert 320 a distance D away from the face 305. The pins 330, 335 act as pivot points for the face insert 320, which flexes inwards and imparts different amount of topspin to a golf ball depending on where the ball strikes the face insert 320. Though the face insert 320 may be composed of a polymeric material, in this embodiment it preferably is composed of a metal material and is welded to the pins 330, 335, which are themselves metal and are welded to the putter head 300 inside or proximate the recessed area 310.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim:

1. A putter-type golf club head comprising:

a body comprising a heel end, a toe end, an aft end, a face, a crown, a sole, and a recess; and an L-shaped face insert comprising face portion, a sole portion, and a hinge portion, wherein the recess comprises a face region and a sole region, wherein the hinge portion comprises a groove, wherein the groove is disposed in an outer surface of the hinge portion, wherein the face portion is disposed in the face region and the sole portion is disposed in the sole region, wherein the sole portion is affixed to the body within the sole region, and wherein the face portion is not affixed to the body.

2. The putter-type golf club head of claim 1, wherein the groove extends along an entire horizontal length of the hinge portion.

3. The putter-type golf club head of claim 1, wherein each of the body and the face insert is composed of one or more metal materials, and wherein the sole portion is welded to the body within the sole region.

4. The putter-type golf club head of claim 1, wherein the body further comprises a sound chamber.

5. The putter-type golf club head of claim 4, wherein the sound chamber comprises a primary chamber and a secondary chamber, wherein the primary chamber communicates with the recess, and wherein the body, the sound chamber, and the face insert amplify the sound generated by the putter-type golf club head striking a golf ball.

6. The putter-type golf club head of claim 1, wherein the face portion of the face insert has a variable thickness pattern.

7. A putter-type golf club head comprising:

a body comprising a heel end, a toe end, an aft end, a face, a top portion, a sole portion, and a recess; and a partial face cup comprising a face portion, a crown portion, a sole portion, and a hinge portion disposed between the face portion and the crown portion, wherein the hinge portion comprises a groove, wherein the groove is disposed in an external surface of the hinge portion, wherein the recess comprises a face region and a sole region, wherein the crown portion is affixed to the body within the face region at a location proximate the top portion, and wherein the face portion and the sole portion are not affixed to the body.

8. The putter-type golf club head of claim 7, wherein the groove extends along an entire horizontal length of the hinge portion.

9. The putter-type golf club head of claim 7, wherein each of the body and the face insert is composed of one or more metal materials, and wherein the face insert is welded to the body.

10. The putter-type golf club head of claim 7, wherein the face portion of the face insert comprises a rear surface and a groove, and wherein the groove extends along a horizontal midline of the rear surface.

11. The putter-type golf club head of claim 7, wherein the body further comprises a sound chamber, wherein the sound chamber comprises a primary chamber and a secondary chamber, wherein the primary chamber communicates with the recess, and wherein the body, the sound chamber, and the face insert amplify the sound generated by the putter-type golf club head striking a golf ball.

12. A putter-type golf club head comprising:

a body comprising a heel end, a toe end, an aft end, a face portion, a rear surface opposite the face portion, a crown portion, and a sole portion;

a face insert; and at least two pins, wherein the face portion comprises a recess having the same approximate size and shape as the face insert, wherein the at least two pins are disposed within the recess and connect the face insert to the body, wherein the at least two pins space the face insert from the body, wherein the face insert is capable of pivoting around the at least two pins, and wherein the face insert does not make contact with any portion of the body.

13. The putter-type golf club head of claim 12, wherein the recess comprises an upper toe-side corner, an upper heel-side corner, a lower toe-side corner, and a lower heel-side corner, wherein the at least two pins comprises a first pin and a second pin, wherein the first pin is at least partially disposed in the upper toe-side corner, and wherein the second pin is at least partially disposed in the upper heel-side corner.

14. The putter-type golf club head of claim 12, wherein each of the body, the face insert, and the at least two pins is composed of a metal material, wherein the at least two pins are welded to the body, and wherein the face insert is welded to the at least two pins.

15. The putter-type golf club head of claim 12, wherein the face insert is spaced a distance of at least 0.005 inch and no more than 0.100 inch from the face portion along a horizontal axis extending from the face portion through the aft end of the body.

* * * * *